United States Patent [19]

Oberli

[11] Patent Number: 4,526,046

[45] Date of Patent: Jul. 2, 1985

[54] METHOD AND APPARATUS FOR TRANSFERRING A LIQUID SAMPLE

[75] Inventor: Rudolf Oberli, Langenthal, Switzerland

[73] Assignee: Greiner Instruments AG, Langenthal, Switzerland

[21] Appl. No.: 528,472

[22] Filed: Sep. 1, 1983

[30] Foreign Application Priority Data

Sep. 7, 1982 [CH] Switzerland ..... 5307/82

[51] Int. Cl.[3] ..... B01L 3/02

[52] U.S. Cl. ..... 73/864.16; 73/864.87; 422/100

[58] Field of Search ..... 73/864.02, 864.03, 864.12, 73/864.16, 864.21, 864.81, 864.87; 422/100

[56] References Cited

U.S. PATENT DOCUMENTS

| | | | |
|---|---|---|---|
| 620,066 | 2/1899 | Weissgerber | 73/864.02 |
| 2,129,502 | 9/1938 | McCreary | 422/100 X |
| 3,622,279 | 11/1971 | Moran | 73/864.16 X |
| 3,716,338 | 2/1973 | Moran | 73/864.16 X |
| 3,864,979 | 2/1975 | Ayres | 73/864.02 |
| 3,972,683 | 8/1976 | Lape | 73/864.16 X |
| 4,336,000 | 6/1982 | Jorgensen et al. | 73/864.16 X |
| 4,396,024 | 8/1983 | Sarstedt | 73/864.02 X |
| 4,457,184 | 7/1984 | Shiono | 422/100 X |

FOREIGN PATENT DOCUMENTS

| | | | |
|---|---|---|---|
| 156864 | 8/1952 | Australia | 73/864.16 |

*Primary Examiner*—Robert H. Spitzer

*Attorney, Agent, or Firm*—Laubscher, Philpitt & Laubscher

[57] ABSTRACT

A method and apparatus for transferring a liquid sample. The apparatus includes a positive displacement syringe having a storage tube having a central storage chamber therein, a plunger slidably mounted in the upper end of the storage tube, and a cannula connected with an opening which is contained in the lower end of the tube. The apparatus further includes a device for preventing the formation of gas bubbles during the introduction of liquid into the chamber. The device includes a generally cylindrical body member which is vertically arranged within the storage chamber. A portion of the lower end of the body member cooperates with the lower end of the storage chamber wall to define a plurality of liquid passages. The body member remains in contact with the lower end of the storage chamber when liquid sample is aspirated into the storage chamber. The method includes the use of the apparatus for transferring a liquid sample.

9 Claims, 2 Drawing Figures

METHOD AND APPARATUS FOR TRANSFERRING A LIQUID SAMPLE

BACKGROUND OF THE INVENTION

The present invention relates to a method and apparatus for transferring a liquid sample, for example blood serum, from a sample vessel to a processing vessel, and more particularly, to such an apparatus and method for use with an automatic chemical testing apparatus.

DISCUSSION OF THE PRIOR ART

In recent years, methods for performing blood tests have become more fully automated and are performed in increasingly faster time rates, see for example U.S. Pat. Nos. 3,622,279 and 3,716,338 to Moran. Different methods have been developed for faster sampling and transferring of liquids which are to be tested in order to shorten the overall testing time. However, certain difficulties have arisen in the faster transferring procedures, which difficulties result in inaccurate sampling and thereby cause inaccurate test results.

For example, in one type of apparatus and method of the prior art, when a liquid is aspirated at a fast rate into a syringe on an automatic analysis instrument, gas bubbles are developed throughout the liquid column, which bubbles are detrimental to the accurate measuring and testing of the liquid sample. In another apparatus and method of the prior art, such as is disclosed by U.S. Pat. No. 3,972,683, a gas bubble is intentionally formed in the syringe cannula before the introduction of liquid sample into the syringe. In this manner, a separating bubble consisting of ambient air is intentionally formed between the water column and the liquid sample. A flat cylindrical body which sits in the area between the syringe cannula and storage chamber is raised by and separates the air bubble from the water column and reduces the mixing of the sample and the water. However, in practice, the volume of the air bubble varies greatly depending on the existing temperatures and pressures. Thus, the quantity of transferred liquid cannot be accurately measured.

Accordingly, the present invention was developed to overcome the above and other disadvantages of the prior art.

SUMMARY OF THE INVENTION

It is therefore an object of the present invention to provide an improved method and apparatus for transferring a liquid sample at high speeds, which method and apparatus may be used in combination with an automatic analysis instrument. More particularly, it is an object of the present invention to provide a method and apparatus for transferring a liquid sample, which sample is transferred free of gas bubbles and in consistently accurate quantities.

Specifically, the apparatus of the present invention comprises a positive displacement syringe including a storage tube having a central storage chamber therein, a plunger slidably mounted in the upper end of the storage tube, and a cannula connected with an opening which is contained in the lower end of the tube. The apparatus further includes means for preventing the formation of gas bubbles during the introduction of liquid into the chamber, which means includes a generally cylindrical body member which is vertically arranged within the storage chamber. A portion of the lower end of the body member cooperates with the lower end of the storage chamber wall to define a plurality of liquid passages. The body member remains in contact with the lower end of the storage chamber when liquid sample is aspirated up through the cannula, through the passages and into the storage chamber. The body member causes the liquid sample to flow through the liquid passages and into the storage chamber in such a manner that the bubble-forming turbulences are avoided, even when the liquid sample is introduced into the syringe at very high speeds. The method for using the present apparatus is also disclosed.

BRIEF DESCRIPTION OF THE DRAWING

Other objects and advantages of the present invention will become apparent from the following detailed description when viewed in light of the drawing, in which.

DETAILED DESCRIPTION

Figure 1:
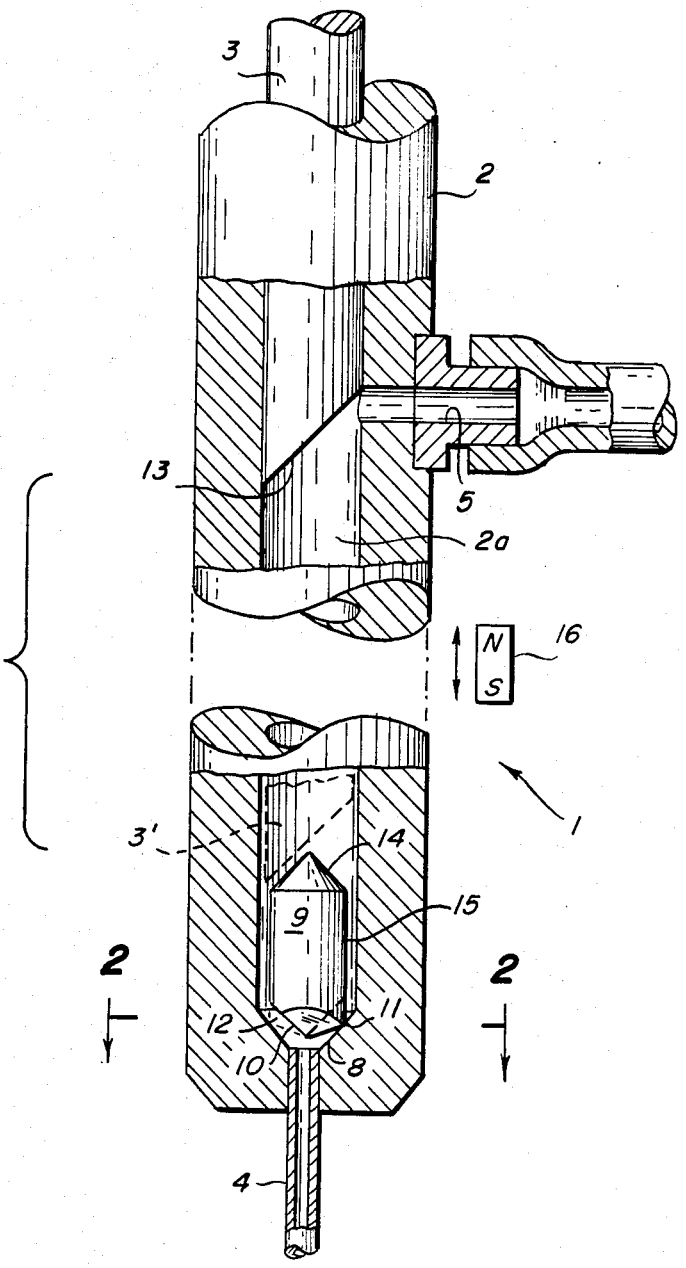
FIG. 1 is a cross-sectional view of the apparatus of the present invention.

With respect to FIG. 1, the apparatus of the present invention comprises a positive displacement syringe, disclosed generally by the reference numeral 1, for transferring a liquid sample from a sample vessel to a process vessel. The syringe 1 includes a vertically arranged, cylindrical storage tube 2 containing a vertical bore which extends downwardly from the upper end of the tube and terminates in spaced relation from the lower end of the tube. The bore defines a storage chamber 2*a*. An opening is provided at the lower end of the storage tube, which opening communicates with the storage chamber 2*a*.

The syringe 1 further includes a plunger member 3 which is slidably mounted in the upper end of the bore for vertical movement between an upper position in which the plunger is shown by solid lines in FIG. 1 and a lower position in which the plunger is shown by broken lines and designated 3' in FIG. 1. In a preferred embodiment, the lower extremity of the plunger member 3 is profiled to define a flat angularly-arranged surface 13. The surface 13 has an angle of inclination of 45°. A cannula member 4 is connected with the opening in the lower end of the storage tube. A lateral opening 5 discussed in greater detail below, is provided in the wall of the storage chamber 2*a*.

Preferably, the lower end of the chamber wall coverges downwardly toward the opening in the lower end of the storage tube to define a frusto-conical transition surface 8 between the cannula 4 and the main portion of the storage chamber 2*a*. The frusto-conical transition surface 8 preferably has an angular inclination of 45°.

The apparatus of the present invention further includes means for preventing the formation of gas bubbles during the introduction of liquid into the storage chamber when the plunger is displaced toward its upper position. The bubble-preventing means includes a generally cylindrical body member 9 which is vertically arranged within the storage chamber 2*a*. A portion of the lower end of the body member 9 is operable to cooperate with the frusto-conical transition surface 8 in the storage chamber to define a plurality of liquid passages 12 therebetween.

Figure 2:
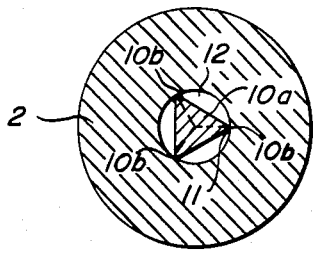
FIG. 2 is a cross-sectional view taken along line 2—2 of FIG. 1.

In a preferred embodiment, the lower end of the body member 9 is profiled to define an inverted three-sided pyramid 10. The sides 10*a* of the pyramid are angularly arranged at an inclination of 45°, equal to that of the frusto-conical transition surface 8. Thus, the three corners 10*b* formed by the intersection of adjacent sides 10*a* of the pyramid, respectively are in contact with the frusto-conical transition surface 8 at contact points 11 and cooperate therewith to form the liquid passages 12 as shown in FIG. 2.

The diameter of the main cylindrical portion of the body member 9 is small enough so that the passage 15 formed between it and the wall of the storage chamber is equal to or larger than the largest liquid passage 12. The upper end of the body member has an upwardly directed conical profile 14 having an angle of inclination of 45°, equal to that of the plunger member flat surface 13.

In accordance with a characterizing feature of the present invention, the body member portion which contacts the transition surface 8 remains in contact therewith when liquid flows upwardly from the cannula to the storage chamber via the liquid passages 12. As will be discussed in further detail below, this prevents any gas bubbles from forming in the fast flowing liquid as it enters the storage chamber.

In a first embodiment, the body member 9 is made of a corrosion-resistant steel and is of such a weight that its weight alone provides sufficient force to hold the body member in contact with the transition surface 8 when liquid flows from the cannula into the storage chamber. In a second embodiment, the body member 9 may be fixedly secured in contact with the transition surface 8, for example by soldering at the contact points 11.

In a third and most preferred embodiment, at least a portion of the body member 9 comprises a ferromagnetic material and the wall of the storage tube 2 is magnetically permeable. The body member 9 is held in contact with the transition surface 8 by means of a magnetic field applied from a magnetic means 16 located outside of the syringe 1. The magnetic field may also be oscillated vertically, either by means of coils which are arranged in a stationary manner along the storage tube 2 and which are excited alternately, or through vertical oscillation of permanent magnets, in order to so vertically move the body member 9 within the storage chamber. This is particularly preferred when it is necessary to stir the liquid contents of the storage chamber. The magnetic field means comprise those known generally in the art.

The apparatus of the present invention further includes means which are operable when the plunger is in its upper position for supplying cleaning fluid to the storage chamber to effect cleaning of the chamber, passages, and cannula. This supply means includes the lateral opening 5 contained in the storage chamber wall. The opening 5 is at such a height in the chamber wall that it is exposed and in liquid communication with the chamber only when the plunger is in its upper position and the flat angular surface 13 of the plunger is opposite the opening. The highest point of the flat surface 13 is aligned with the upper edge of the opening 5 when the plunger is in its upper position.

Additional advantages of the present apparatus will be disclosed from the following description of the related method for transferring a liquid sample.

In operation, at least the lower portion of the syringe is filled with liquid. Preferably, the syringe 1 is initially filled with bubble-free water, and the plunger 3 is moved to its lower position to expel an excess quantity of water. The syringe is moved to a sample acceptance point, i.e. a liquid-containing sample vessel, and the lower end of the cannula is brought into contact with the surface of the liquid sample which is, for instance, blood plasma. A liquid bridge is thereby formed between the liquid sample and the water contained in the cannula without any air being admitted therebetween.

The liquid sample is aspirated into the syringe by moving the plunger member 3 to its upper position. The liquid is first introduced into the cannula and then flows upwardly through the liquid passages 12 and into the storage chamber 2*a*, thereby forming a continuous bubble-free liquid column of diluted liquid sample and water extending from the tip of the cannula to plunger surface 13. The body member 9 remains in contact with the transition surface 8 during the entire process thereby causing the liquid column to divide and flow upwardly through the liquid passages. This prevents any turbulence or under pressure zones from occurring in the flowing liquid which would cause spontaneous formation of gas bubbles. The liquid reunites into a single stream in passage 15 once it flows through the passages 12 and remains bubble free. Movement of the plunger 3 is controlled, for example by means of level sensors, to prevent any break in the liquid bridge.

The aspiration process is completed when the highest point on plunger surface 13 is just below the lateral opening 5. The entire syringe 1 is then raised and shifted laterally in the direction of the process vessel dispensing area. Prior to dispensing the diluted liquid sample however, the liquid in storage chamber 2 is thoroughly mixed by means of the aforementioned stirring means. That is, the magnetic field generated by the magnetic means 16 is moved vertically in an oscillating manner. Thus, the body member 9 which includes ferromagnetic material rapidly moves vertically within the storage chamber and stirs the liquid therein to form a homogeneous solution.

The plunger 3 is then lowered to an extent that the insufficiently mixed part of the sample located in the cannula or adjacent the transition surface 8 is expelled, for example, into a cell having an ion-sensitive electrode or into a waste removal outlet.

The syringe 1, containing a known amount of homogeneous diluted liquid sample, is then brought laterally to the dispensing area and the liquid is dispensed into the appropriate processing vessel or vessels by progressive movement of the plunger 3 to its lower position.

After the final discharge of sample liquid, the syringe 1 is moved laterally in the direction of the sample aspiration point and the plunger 3 is moved to its upper position wherein the lateral opening 5 is brought into liquid communication with the storage chamber and the upper edges of the plunger surface 13 and the opening 5 are in alignment. A cleaning fluid, for example, water mixed with a detergent, is supplied under pressure through the opening 5 into the storage chamber. The rinsing liquid is conducted downwardly through the cannula 4 into a waste removal outlet. The body member 9 ensures that sample remnants, stuck in the storage chamber, passages or cannula, will be completely removed. In a similar manner, the slant of the plunger front surface 13 creates an advantageously directed liquid flow. The cleaning fluid is discharged through the cannula in a waste outlet.

Finally, a water source is arranged under the tip of the cannula, and a suction is applied through the opening 5. The body member 9 remains in contact with the transition surface 8 as water flows upwardly through the cannula, passages 12 and 15 and the storage chamber. Air bubbles which have developed in these areas after dispensing are moved upwardly by the water to the plunger 3 whereby surface 13 guides the bubbles toward opening 5 where they are suctioned out. The plunger 3 may then be moved to its lower position and the syringe is ready to perform another liquid sample transfer.

In additional embodiments of the present invention, the plunger surface 13 may be profiled to define an inverted funnel or different dilution and rinsing liquids may be used without departing from the scope of the invention.

While the preferred forms and embodiments of the invention have been illustrated and described, it will be apparent that various modifications may be made without deviating from the scope of the invention set forth above.

What is claimed is:

1. Apparatus for transferring a liquid sample, comprising (a) a positive displacement syringe, including (1) a vertically arranged cylindrical storage tube (2) containing a vertical bore extending downwardly from its upper end and terminating in spaced relation from its lower end, said bore defining a storage chamber (2*a*), said storage tube containing an opening at its lower end communicating with said chamber, the lower end of the chamber wall converging downwardly toward said opening to define a frusto-conical transition surface (8);

(2) a plunger member (3) slidably mounted in the upper end of said bore for vertical movement between upper and lower positions relative to said storage tube; and (3) a cylindrical cannula member (4) connected with the opening in the lower end of said storage tube; and (b) means for preventing the formation of gas bubbles during the introduction of liquid into the chamber when said plunger is displaced toward its upper position, including a generally cylindrical body member (9) vertically arranged within said storage chamber, a portion of the lower end of said body member being operable to cooperate with said frusto-conical transition surface to define a plurality of liquid passages (12) therebetween, said body member portion remaining in contact with said frusto-conical transition surface when liquid flows from said cannula into said chamber via said passages.

2. Apparatus as defined in claim 1, and further including means (5) operable when said plunger is in said upper position for supplying cleaning fluid to said storage chamber, thereby to effect cleaning of said chamber, said passages and said cannula when said cleaning fluid is discharged via said cannula.

3. Apparatus as defined in claim 2, wherein said body member is vertically movable within said storage chamber, and further wherein the lower end of said body member is profiled to define an inverted three-sided pyramid (10), the three corners formed by the intersection of adjacent sides (10*a*) of said pyramid being in contact with and cooperating with said frusto-conical transition surface, thereby to form said plurality of liquid passages.

4. Apparatus as defined in claim 3, wherein the lower extremity of said plunger is profiled to define a flat angularly arranged surface (13), said cleaning fluid supply means including an opening contained in said storage tube opposite said flat plunger surface when said plunger is in its upper position.

5. Apparatus as defined in claim 4, wherein the upper end of said body member has an upwardly directed conical profile having the same angle of inclination as said plunger member flat angularly arranged surface.

6. Apparatus as defined in claim 5, wherein the wall of said storage tube is magnetically permeable, and further wherein at least a portion of said body member comprises ferromagnetic material, whereby said body member may be moved vertically within said storage chamber by magnetic mixing means to stir the liquid contents of said storage chamber.

7. Method for transferring a liquid sample with an apparatus comprising a positive displacement syringe including a vertically arranged cylindrical storage tube containing a downwardly extending vertical bore defining a storage chamber and an opening at its lower end communicating with the chamber, a plunger member slidably mounted in the upper end of the bore for vertical movement relative to the tube, and a cylindrical cannula member connected with the opening in the lower end of the storage tube, and means for preventing the formation of gas bubbles during the introduction of liquid into the chamber comprising a generally cylindrical body member vertically arranged within the storage chamber, a portion of the lower end of the body member being operable to cooperate with the lower end of the storage chamber wall to define a plurality of liquid passages therebetween, comprising the steps of:

(a) filling at least the lower portion of said syringe with water;

(b) bringing the lower end of said cannula member into contact with the surface of the liquid sample to be transferred thereby to form a liquid bridge between the water contained in said cannula and said liquid sample;

(c) aspirating said liquid sample into said cannula member and upwardly into said storage chamber to form an upwardly rising continuous bubble-free liquid column of diluted liquid sample, said contacting portion of the lower end of said body member remaining in contact with said lower end of the storage chamber wall, thereby to cause said liquid column to divide and flow upwardly through said plurality of liquid passages formed between said body member and said lower wall surface, the divided liquid column reuniting after passing through said liquid passages and remaining bubble-free;

(d) dispensing said diluted sample to thereby cause said sample to flow downwardly through and out of said storage chamber, said liquid passages and said cannula member; and (e) cleaning said syringe of any remaining sample.

8. Method as defined in claim 7, further comprising the steps of:

(f) vertically moving said body member in said chamber to stir the diluted liquid sample prior to said dispensing step; and (g) releasing the portion of said liquid sample which is not sufficiently mixed with water from said cannula prior to said dispensing step.

9. Method as defined in claim 8, wherein said cleaning step comprises the steps of:

(h) vertically sliding said plunger member to an upper position to expose a lateral opening provided in the wall of said storage chamber;

(i) supplying a cleaning fluid through said lateral opening storage chamber thereby to effect cleaning of said chamber, said passages and said cannula;

(j) discharging said cleaning fluid via said cannula; and (k) supplying water upwardly through said cannula member, said liquid passages and said storage tube and out through the lateral opening.

* * * * *